US006254480B1

(12) United States Patent
Zach

(10) Patent No.: US 6,254,480 B1
(45) **Date of Patent: *Jul. 3, 2001**

(54) WAGERING SYSTEM WITH IMPROVED COMMUNICATION BETWEEN HOST COMPUTERS AND REMOTE TERMINALS

(76) Inventor: Robert W. Zach, 1825 Blakefield Cir., Timonium, MD (US) 21093

( * ) Notice: Subject to any disclaimer, the term of this patent is extended or adjusted under 35 U.S.C. 154(b) by 0 days.

This patent is subject to a terminal disclaimer.

(21) Appl. No.: 09/399,200

(22) Filed: Sep. 17, 1999

Related U.S. Application Data

(63) Continuation-in-part of application No. 08/989,599, filed on Dec. 12, 1997, now Pat. No. 5,954,582.

(51) Int. Cl.[7] ..... A63F 9/22

(52) U.S. Cl. ..... 463/17; 463/16; 463/22; 463/25; 463/40; 463/41; 463/42

(58) Field of Search ..... 463/16–17, 22, 463/25, 40–42

(56) References Cited

U.S. PATENT DOCUMENTS

| | | | | |
|---|---|---|---|---|
| 4,398,708 | * | 8/1983 | Goldman et al. | 270/18 |
| 4,713,787 | | 12/1987 | Rapp | 364/717 |
| 4,842,278 | * | 6/1989 | Markowicz | 273/138 A |
| 4,937,853 | * | 6/1990 | Brule et al. | 379/96 |
| 4,982,337 | | 1/1991 | Burr et al. | 364/479 |
| 5,119,295 | | 6/1992 | Kapur | 364/412 |
| 5,276,312 | | 1/1994 | McCarthy | 235/380 |
| 5,415,416 | * | 5/1995 | Scagnelli et al. | 273/439 |
| 5,417,424 | * | 5/1995 | Snowden et al. | 273/138 A |
| 5,871,398 | * | 2/1999 | Schneier et al. | 463/16 |
| 5,954,582 | * | 9/1999 | Zach | 463/25 |
| 6,024,640 | * | 2/2000 | Walker et al. | 463/17 |

* cited by examiner

*Primary Examiner*—Valencia Martin-Wallace
*Assistant Examiner*—Carmen D. White
(74) *Attorney, Agent, or Firm*—Leonard Bloom

(57) ABSTRACT

A computer selected "quick pick" wagering system uses keys in the form of random numbers to serve as seed numbers in a pseudo-random number generating algorithm. A sales agent's terminal uses the algorithm and seed to produce random number combinations for each play from a pool, assigning the number combinations sequentially and printing them, together with a sequential serial number, onto lottery tickets. By storing the algorithm and seed at both the host computer and remote agent terminal, the remote terminal can transmit all pertinent wagering information by only transmitting the actual count of plays sold, thereby reducing the amount of data exchanged by several orders of magnitude. The host computer can then reconstruct the wagers and compare them to winning number combinations. Liability information for each terminal is transmitted back to the agent together with new seed numbers, so the agent terminal may begin selling plays for a new pool while also verifying accurate data exchange. The reduced data exchange makes available novel methods of data transfer, such as satellite packet transmission and cellular service.

3 Claims, 1 Drawing Sheet

WAGERING SYSTEM WITH IMPROVED COMMUNICATION BETWEEN HOST COMPUTERS AND REMOTE TERMINALS

This application is a continuation-in-part of U.S. application Ser. No. 08/989,599 filed Dec. 12, 1997, now U.S. Pat. No. 5,954,582.

BACKGROUND OF THE INVENTION

1. Field of the Invention

This invention pertains to computerized wagering systems generally, and more specifically to a wagering system with improved communication between a central computer and remote terminals.

2. Description of the Related Art

Lotteries are used by many countries, states and localities as a way to generate revenue without raising taxes. There are various games available for wagering, such as Lotto and Keno, dependent upon the locality. In a typical lottery, a player will select or may be assigned a set of numbers upon which to wager. Each number set is referred to as a play, and the combination of all plays is referred to as the pool. From the pool an administrator will usually withdraw a percentage of money wagered, and the remainder will be available to the players in the form of winnings. The winnings may be distributed to one or more players, once again depending upon the rules of the particular game. The numbers chosen by the player in a single play may be required to be unique in some games, while in pari-mutuel games a number may be shared by many players, resulting in divided winnings. Furthermore, there may also be winnings for numbers that only partially match the winning number. For example, games that require six different numbers will often pay winnings to players that have matched three, four or five of the six numbers. The biggest prize, however, will typically be reserved for a player who matches all six numbers. In many games, some or all of the winnings may be rolled over to a new game, in the event there are not any matches for the particular category of winnings.

One lottery game which assigns number sets to players uses random numbers generated by a central computer to produce so-called "quick picks." These games reduce the probability of duplicate winners and consequential lowering of payoff prices common in pari-mutuel games. The larger top prize payouts help with publicity, and the games are popular among casual users. Tickets are preferably generated on-site, which reduces the risk of tickets being improperly printed or altered, while also simplifying distribution of tickets. A very desirable feature of the computer generated number selections is the speed at which the player and agent may both complete a wagering transaction, so the benefits of concurrent ticket generation can only be realized if tickets can truly be generated instantly.

Unfortunately, one of the challenges of lotteries, particularly with wide geographical participation, is that a wagering system may be required to process tens or even hundreds of thousands of plays each day. These transactions must be secure, since pay-outs may involve millions of dollars. Security not only includes fraud prevention, but also includes secure storage and retention of each play from a pool. In the prior art, security of the system has been ensured by requiring an agent or vendor to submit wagers to a central location for verification. The central location then relays authorization, often in the form of a ticket serial number which may be used by the vendor to print the lottery ticket. The player gets a printed receipt, while the agent and the central computer may each have a record of the wager. Security is enhanced, since each play is recorded against the particular selling agent, and the central computer will have data necessary to monitor and regulate the activity occurring at an agent's terminal. Inappropriate activity occurring at a single terminal can be quickly recognized, so liabilities from attempted break-ins or theft of sales agent equipment can be constrained. A significant challenge with this system, however, is the need for frequent communication with the central computer.

In older wagering systems, communication with a central location occurred through an exchange of paper documents. However, the paper was easily altered or damaged, and clerical errors were a problem. Furthermore, wide geographic areas were difficult to process quickly, limiting such systems mostly to relatively small, local pools. With more economical desktop data processing capability came the ability to reduce or eliminate human intervention, thereby eliminating clerical errors. Some systems began using magnetic media instead of paper to transport plays to the central location. The magnetic media addressed some clerical issues, but exchanging magnetic media did not improve turn-around time or system security, since the media could still be tampered with and still required time for physical transport to a central location.

Today, improved telecommunications systems allow nearly instantaneous exchange between agent terminals and the central computer, eliminating the need for a package courier and reducing any delay that might be associated therewith. Desktop computers process a play and then establish a telecommunications link with a central computer through either a dial or dedicated line. Therein lies a constraint, however. The amount of data exchanged between an agent terminal and central computer is relatively small, which would normally dictate a dial up line. Unfortunately, the cost associated with remote locations dialing in using long distance circuits can be prohibitive, limiting the geographical region for the lottery to the local calling area. Furthermore, any delay in processing is inconvenient to both players and agents, particularly with the computer selected numbers games. Yet the dial line requires the added delay of establishing the telephone connection. When larger payouts are available and the lottery widely publicized, sales should be most rapid. Unfortunately, it is those same days when demand is the greatest that the telecommunication lines tend to encounter more "busy" connections. As a result, dial up lines are generally unacceptable.

One alternative to the dial-up connection is the use of a dedicated telecommunications link which is available for immediate data exchange. With this type of link, dialing delays, including "busy" signals, are eliminated. Unfortunately, such links are prohibitively expensive and can usually only be justified for the busiest of agent systems, or where there are a number of agent terminals in close physical proximity which can be grouped together to share such a link. Furthermore, in spite of the high costs associated with hard-wired links, there is nothing to be gained in terms of system delays which occur on the busiest days. While each play may contain a seemingly small amount of data, the central computer must still receive and process the data on each play. On those busy days when tens or hundreds of thousands of plays need to processed, even fairly small data amounts can easily flood a system and tremendously delay processing. State of the art systems address this problem by designing networks and systems capable of handling these peak loads (although requiring a capital investment in facilities). In developed countries, the communications infrastructure can support these requirements. In areas where the infrastructure is not available, alternate technologies may be required involving private networks using satellite and radio links custom designed for this purpose. These methods substantially increase the cost of lottery systems.

The prior art has disclosed various improvements, but these improvements are not completely satisfactory.

For example, McCarthy, in U.S. Pat. No. 5,276,312 incorporated herein by reference, proposes another more recent alternative. In the McCarthy system desktop or hand held agent terminals are used to process and accumulate plays off-line, with subsequent transmission to the central computer. Upon establishing a connection with the central computer, the agent terminals will download complete information such as a unique agent terminal identification, serial numbers of tickets sold, numbers selected on each play, and other similar known information which may be desired, even, in some instances, including complete demographic information on the player. By enabling the agent terminals to process and accumulate data in a secure manner, the wagering system may operate in either an on-line mode or an off-line mode, allowing the system to operate nearly instantaneously, even in the event the central computer becomes intermittently inaccessible. Unfortunately, however, the McCarthy system must still transmit a full, potentially very large record of data for each ticket sold, including selected wager numbers and ticket serial numbers.

Moreover, Burreta et al, in U.S. Pat. No. 4,982,337, discloses an instant ticket wagering system. In the Burr et al wagering system, agent terminals (therein referred to as point-of-sale terminals) are equipped with modems, enabling communication with a central computer over standard dial-up telephone lines. Either the agent terminals or the central computer can initiate communication, and preferably the sales agent is not responsible for initiating or making the connection, but instead the terminals are accordingly programmed. Communication may advantageously be during off hours, allowing the agent terminals to respond instantaneously to players during sales periods and instantaneously to the central computer at other times. However, the Burr et al system disadvantageously uses pre-printed tickets which are bearer instruments having value. The tickets may be altered or stolen more readily, and must be accounted for carefully. The Burr et al disclosure illustrates this accounting system. However, there is no disclosure nor suggestion on how to improve the performance of on-line or off-line wagering systems using "quick pick" tickets generated at the point-of-sale terminal or how to reduce the data transmission requirements of such a system.

Additionally, Kapur, in U.S. Pat. No. 5,119,295 discloses an off-line method of selling lottery tickets using a large number of security techniques and encryption methods useful for security purposes. While many of these techniques could find application in the present invention and are therefore also incorporated herein by reference, there are no teachings which illustrate how to reduce the amount of data transferred to the central, or host computer. Rapp, in U.S. Pat. No. 4,713,787 is also incorporated herein by reference for his disclosure of suitable algorithms which could be used together with the present invention to generate random numbers.

SUMMARY OF THE INVENTION

In a first manifestation, the invention comprises a method of operating a computerized lottery system, wherein the necessity for spontaneously transmitting each individual wager from a remote terminal to a host computer is eliminated, and wherein the total amount of data transmitted therebetween is substantially reduced, thereby reducing the consequent cost of transmission and enhancing the number and types of economically viable transmission alternatives. This manifestation of the invention includes the steps of providing a host computer and a remote terminal; generating a seed number at the host specific to a pool and the remote terminal; transmitting the seed to the remote terminal; producing pseudo-random wager numbers sequentially for sequential plays within the pool; conveying from remote to host a total number of sequential plays; and reconstructing at the host pseudo-random wager numbers and serial numbers associated with each of the plays from the total number of sequential plays.

In a second manifestation, the invention comprises a method of securely and compactly communicating wagering information regarding plays of a game between remote computers. This manifestation of the invention comprises the steps of establishing one remote computer as a host terminal and establishing one remote computer as an agent terminal; delivering to the remote computers a pseudo-random number generating algorithm; generating and delivering a seed number to the remote computers; using the algorithm and seed number to produce pseudo-random wager numbers; assigning at the agent terminal wager numbers and sequential serial numbers to sequential plays made at the agent terminal and creating a wager receipt for each of said plays therefrom; closing the game; conveying a total number of sequential plays from agent terminal to host terminal; reconstructing wager numbers and serial numbers at the host terminal from the algorithm, seed number and total number of said plays provided by the agent terminal; determining winning wagers; ascertaining a liability of remote computers based upon winning wagers and wager numbers; and communicating winning selections and liability data to the remote computers.

Other manifestations of this invention are also disclosed herein, comprising additional steps, such as printing wager tickets, developing multiple algorithms for different games, and cashing winning tickets.

OBJECTS OF THE INVENTION

A first object of the present invention is to provide off-line, instantaneous sales of computer selected number plays. A further object of the invention is to reduce the amount of data transmitted between a central computer and each agent terminal. Another object of the invention is to improve system security over the prior art for such an off-line wagering system. A further object of the invention is to enable remote terminals to economically access a central computer through short message satellite packet transmission systems as well as dial up networks, possibly including the Internet. Yet a further object of the invention is to enable rapid setup of lottery agents, without investment and delay attributable to communication infrastructure of traditional on-line lottery systems. These and other objects of the invention are achieved in the preferred embodiment, which offers significant advantage over prior art communication systems.

In an alternate embodiment of the system and method of the present invention, the algorithm is located only in the host and a series of tickets is generated in the host and transmitted to the terminal, say by floppy disk. The terminal would then merely transmit a total to the host.

DESCRIPTION OF THE PREFERRED EMBODIMENT

Figure 1:
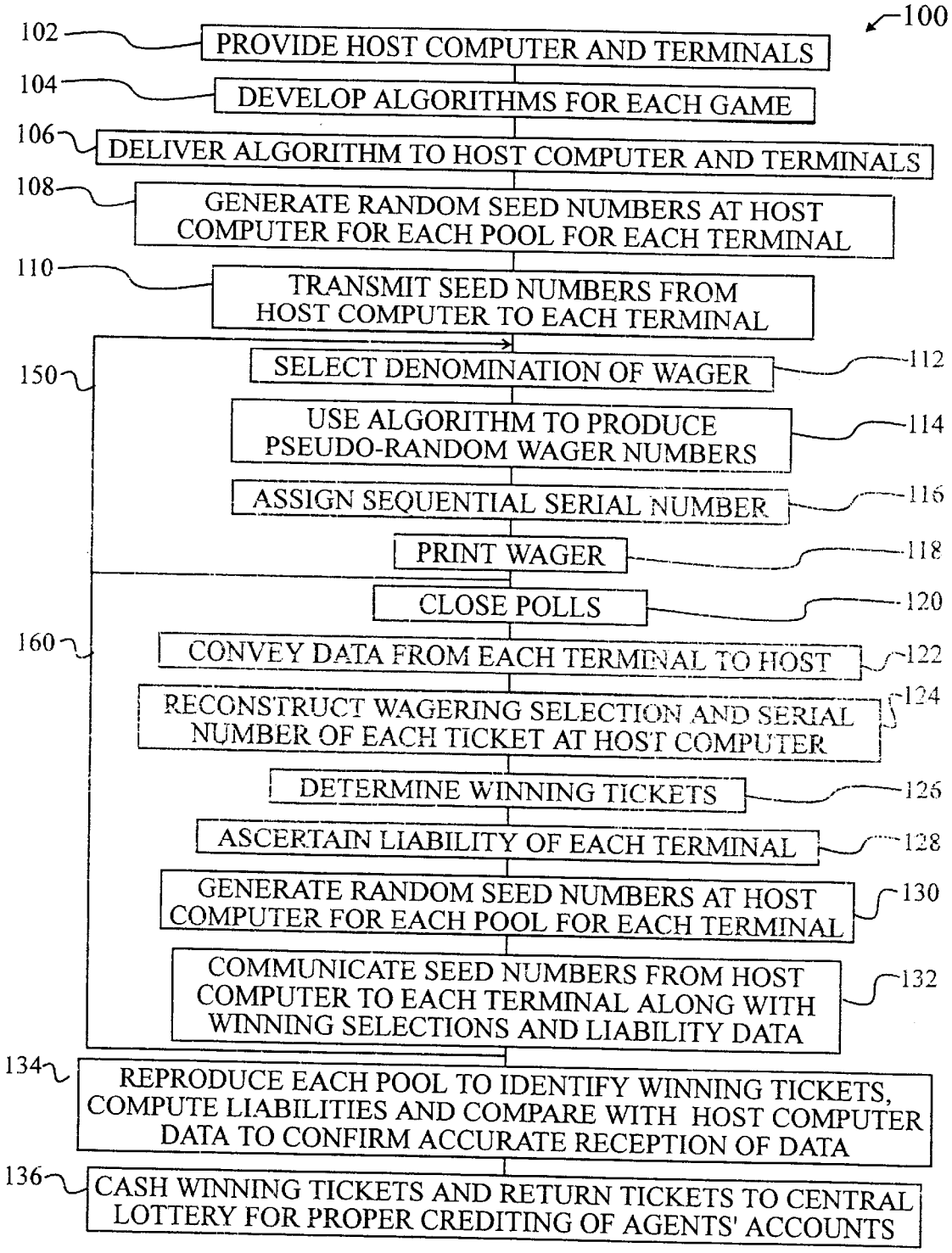
FIG. 1 is a flow chart which illustrates various steps of the preferred embodiment of the present invention.

Wagering system communication method 100 comprises various steps, or protocol, for communication between sales agent terminals and a host computer. Step 102 is the provision of host computer and terminals. In the prior art, the host computer was usually a main frame computer designed for rapid, high volume transaction processing. While that is still the preferred embodiment, it should be understood that with the rapid advances in computer hardware a variety of other types of computers are contemplated. Exemplary are distributed processing systems and the progressively more powerful workstations and desktop computers. Similarly, terminals may take many forms, ranging from specially designed lottery dispensers to multi-purpose devices such as grocery check-out scanners and may even include portable or mobile hand-held devices.

The present invention does not require any dedicated communications lines, thereby avoiding any delays that might arise from waiting for the establishment of the line. By not demanding unusual or unavailable computer hardware, method 100 offers significant advantages to many existing systems, as will be outlined and described hereinbelow, and makes new, previously uneconomical systems economically viable.

In step 104, pseudo-random number generator algorithms are developed for each different lottery game to be controlled by the host computer. While not essential to the rest of the invention, the inclusion of step 104 provides improved security across various wagering games. If security provisions of one game should be violated, including accessing the algorithm used for that game, only that game will be affected. The algorithms may be of the type described in Rapp, previously incorporated herein by reference, or may be of the type employed in some programming languages. The particular algorithm used is not critical to the invention, and many alternatives are known and available, though algorithms that provide good statistical distribution of numbers are most preferred.

The algorithm must be delivered to both the host computer and all remote terminals in step 106. In order for communication method 100 to work, the host and terminals must all be using the same algorithm for the same game. The algorithm may be delivered to all of the computers and changed periodically by transmission over the telecommunications line, or may be provided through some other media, depending upon the level of security required. Various media are contemplated for delivery, including magnetic and optical media, and semiconductor chips such as EPROM and EEPROM devices including those incorporated into cards and other portable devices. Once again, the particular delivery media is not critical to the invention, and depending upon particular security requirements, various media may offer relative advantage at different times. Even the courier methods may be varied to include telecommunications transmissions, package courier services, personal visits and other known methods.

Once the agent terminals are provided with an algorithm, they must be provided with a seed number to start a new pool in a game. The seed numbers are generated in step 108 at the host computer, normally through the generation of a set of random seed numbers using an algorithm similar to those developed in step 104. The seed numbers are transmitted from the host computer to each agent terminal in step 110. The host computer will record and store the seed numbers together with data fields to identify which terminal received a particular seed and which game the seed will be used for. Transmission 110 will most frequently occur over a telecommunication link, and will require very few data bytes, since a seed number will typically only be a few digits in length. While it should be noted that the seed itself provides enhanced security against intercepted transmissions due to its random nature, systems requiring more extensive security transmission of the seed numbers may encrypt the seed with various digit scrambling techniques to prevent unauthorized access. Once transmission 110 is completed, agent terminals are self-sufficient and will generally operate in an off-line mode through steps 112–118, which describe the sale of each individual play.

In step 112, a ticket agent or terminal will request a player to select a particular denomination of wager. The unit denomination is predetermined for each game, and so the wager can only be in whole number multiples of the unit denomination. For example, a five dollar unit denomination game will only allow wagers of one, two, three or more times the unit denomination, amounting to five, ten, fifteen, or more dollars. Each unit denomination will represent an individual play, so a wager of three times the unit denomination will be treated as three separate plays. The terminal will use the algorithm delivered in step 106 and the seed number transmitted in step 110 to generate pseudo-random wager numbers in step 114. Each sequential play will be assigned the next pseudo-random wager number in the sequence, and a sequential serial number will also be assigned to the play in step 116. In addition to the sequence number, additional information on the ticket will include the terminal identifier and the date of the ticket draw. This information may be encrypted to aid against attempted alteration of the ticket as is done in traditional systems.

It is important to note that the exact sequence of step 114 relative to steps 112 and 116 is not critical. For example, the sequence of pseudo-random numbers may be generated well in advance of actual wagering. Once wager numbers and serial numbers have been assigned to all of the plays in a particular wager, the wager will most preferably be printed onto lottery tickets in step 118. The lottery tickets serve as a receipt and claim check for use by the player. Many alternatives are known and available to the printing of tickets and will be understood to be incorporated herein. However, and for various reasons, the printing of tickets is most preferred and widely accepted. Once all tickets associated with a wager are printed, the agent terminal is ready to process the next wager at step 112, as shown by flow line 150.

At some time, usually announced in advance, a game will be scheduled to be closed as shown in step 120. The actual closing will be accomplished in the preferred embodiment by a message sent from the host computer to each terminal. An alternate means would be to transmit the closing time and date along with the original seed data which was transmitted before the pool was opened for sales. Accurate timing information can be obtained by the terminal from various sources including an internal clock and or timing information from WWV transmissions provided by the National Bureau of Standards or GPS signals available worldwide from inexpensive receivers. The terminals then calculate the number of tickets sold for each game, herein referred to as counts, and then convey the counts back to the host in step 122. The counts are conveyed to the host using a fixed length message which is independent of the number of tickets sold in each game. In addition to conveying the counts, the terminals will identify themselves in a way unique to each terminal. The identifier may be as simple as a few digit indicia or may be more advanced, potentially using the caller identification sequence used on many telecommunications systems. Once again, the level of security desired for the system will dictate the particular indicator, as illustrated by the Kapur reference previously incorporated herein.

The conveyance of counts to the host requires a very short block of data. The data block may be many orders of magnitude shorter than blocks of data transmitted in the prior art. For example, a typical terminal may generate several thousand transactions per week. In a typical prior art system, each wager results in approximately 50 bytes of data and may yield about 100 kilobytes of data per week. The present invention requires less than 100 bytes of data to accomplish the same exchange of information, or only one thousandth the data. Because of the vastly reduced amount of data to be exchanged, and because the agent terminals may be operated off-line for extended periods, many communications methods may be used to convey the counts. For example, the price of access to satellite packet transmission systems is based in part on the amount of data to be transmitted, and is not normally economical using prior art wagering methods. Satellite transmission, specifically VSAT technology, is used for transmission of lottery information; dedicated links are required, and the costs are high.

However, the present invention enables economical usage of such packet transmission systems. Furthermore, the off-line sale of wagers allows each sales agent terminal to process wagers instantaneously, meeting the timing requirements not achieved by other prior art systems. In effect, each agent terminal acts as a distributed processor, separately and independently handling the actual sales transactions and accumulating them for simple transmission back to the host after poll closing step 120. In the present invention then, the host computer does not act as a block or delay on peak wagering days. Customers may continue to be served nearly instantaneously, thereby improving both short and long term sales achieved by each agent terminal and enhancing the goodwill associated with the agent.

Once all of the data is conveyed to the host as in step 122, the host begins to reconstruct each play including the wagering selection and serial number of each ticket, as shown in step 124. Since the host has each algorithm and each seed number used at a terminal, the host can reproduce the pseudo-random sequence of wagers sold by the terminal. As long as the host has stored or receives the first serial number and the total count, all of the ticket information can be reproduced by the host for each wager. Next, winning tickets are determined in step 126. There are many methods presently employed for determining winning tickets, ranging from widely televised and elaborate drawings of winning number combinations to simple computer random number picks using yet another seed number or algorithm. Once the winning numbers are determined, this information is introduced to the host computer, and wiring tickets are determined. Within the host the liability of each terminal is ascertained in step 128. A new random seed number is generated for each pool for each terminal in step 130, which is identical to step 108, and the new seed numbers, winning selections and liability data are all transmitted to each agent terminal in step 132. The order of steps 128 and 130 is not critical.

Each agent terminal is now ready to begin processing wagers for a new pool, and so the steps of selling wagers will restart beginning with step 112, as shown by flow line 160. Separately, each agent terminal will reproduce each pool and compare the wager numbers sold to the winning numbers and compute liabilities. The liabilities should correspond with the host computer data transmitted in step 132, to confirm accurate reception of all data, as shown in step 134. The sales agent may then cash winning tickets and return the tickets to a central lottery office for proper crediting of agents accounts, thereby concluding a single pool of plays.

Each agent terminal may be adapted to simultaneously process several different games, in which case each game might preferably follow a separate flow through method 100, though the overall method will be the same. Additionally, the number of agent terminals is nearly limitless, in view of the minimal amount of interchange between host and agent. Furthermore, agent terminals may be fixed in location, such as the grocery store bar code scanners mentioned earlier, or could conceivably be remote, mobile hand-held devices useful, for example, on board a ship and interconnected via satellite and/or cellular telephone links. The drastic reduction in data transmission afforded by the present invention advantageously offers new degrees of freedom to wagering systems.

While the foregoing details what is felt to be the preferred embodiment of the invention, no material limitations to the scope of the claimed invention are intended. Further, features and design alternatives that would be obvious to one of ordinary skill in the art are considered to be incorporated herein. With this in mind, the scope of the invention is set forth and particularly described in the claims hereinbelow.

I claim:

1. The method of operating a computerized lottery system, wherein the necessity for spontaneously transmitting each individual wager from a remote terminal to a host computer is eliminated, and wherein the total amount of data transmitted therebetween is substantially reduced, thereby reducing the consequent cost of transmission and enhancing the number of types of economically viable transmission alternatives, comprising the steps: of providing a host computer; providing at least one remote terminal; generating a seed number at the host computer specific to a pool and the remote terminal; transmitting the seed number to the remote terminals; producing pseudo-random wager numbers sequentially for sequential plays within a pool at the remote terminal; conveying from the remote terminal to the host computer a total number of sequential plays; and reconstructing pseudo-random wager numbers and serial numbers associated with each of the plays at the host computer from the total number of sequential plays.

2. The method of operating a computerized lottery system, wherein the necessity for spontaneously transmitting each individual wager from a remote terminal to a host computer is eliminated, and wherein the total amount of data transmitted therebetween is substantially reduced, thereby reducing the consequent cost of transmission and enhancing the number of types of economically viable transmission alternatives, comprising the steps of: providing a host computer; providing at least one remote terminal; generating a series of tickets at the host computer and transmitting the series of tickets to the remote terminal; producing pseudo-random wager numbers sequentially for sequential plays within a pool at the remote terminal; conveying from the remote terminal to the host computer a total number of sequential plays; and reconstructing pseudo-random wager numbers and serial numbers associated with each of the plays at the host computer from the total number of sequential plays.

3. An apparatus for operating a computerized lottery system, wherein the necessity for spontaneously transmitting each individual wager from a remote terminal to a host computer is eliminated, and wherein the total amount of data transmitted therebetween is substantially reduced, thereby reducing the consequent cost of transmission and enhancing the number of types of economically viable transmission alternatives, the apparatus comprising: a host computer; a remote terminal; means for generating a seed number at the host computer specific to a pool and the terminal; means for transmitting the seed number to the terminal; means for producing pseudo-random wager numbers sequentially for sequential plays within the pool at the terminal; means for conveying from the terminal to the host computer a total number of the sequential plays and a means for identifying the terminal uniquely; and means for reconstructing pseudo-random wager numbers and serial numbers associated with each of the plays at the host computer from the total number of sequential plays and the identifying means.

* * * * *